US008063723B2

(12) United States Patent
Rossiter et al.

(10) Patent No.: US 8,063,723 B2
(45) Date of Patent: Nov. 22, 2011

(54) FILTER APPARATUS AND METHOD

(75) Inventors: Christopher Rossiter, Westbrook, ME (US); Robert Dunning, Naples, ME (US)

(73) Assignee: SPX Corporation, Charlotte, NC (US)

( * ) Notice: Subject to any disclaimer, the term of this patent is extended or adjusted under 35 U.S.C. 154(b) by 203 days.

(21) Appl. No.: 12/496,148

(22) Filed: Jul. 1, 2009

(65) Prior Publication Data

US 2011/0001583 A1 Jan. 6, 2011

(51) Int. Cl.
*H01P 1/20* (2006.01)

(52) U.S. Cl. ..... 333/202; 333/219.1

(58) Field of Classification Search ..... 333/202, 333/203, 206, 207, 212, 219, 219.1
See application file for complete search history.

(56) References Cited

U.S. PATENT DOCUMENTS 4,761,625 A * 8/1988 Sharma ..... 333/209
5,684,438 A * 11/1997 Cavalieri D'Oro et al. .. 333/202
5,825,267 A * 10/1998 Smith ..... 333/235
6,081,173 A * 6/2000 Sonoda et al. ..... 333/202
6,356,171 B2 * 3/2002 Fiedziuszko et al. ..... 333/212
6,573,812 B1 * 6/2003 Wakamatsu et al. ..... 333/219.1
6,642,814 B2 * 11/2003 Lamont et al. ..... 333/202
6,703,911 B1 3/2004 DeCormier
7,106,151 B1 * 9/2006 Honeycutt et al. ..... 333/204
7,250,833 B2 * 7/2007 Eddy ..... 333/202
7,449,981 B2 * 11/2008 Park et al. ..... 333/203
2003/0193378 A1 * 10/2003 Karhu ..... 333/202
2003/0203717 A1 10/2003 Chuprun et al.
2008/0211603 A1 9/2008 Uhm et al.
2009/0015903 A1 1/2009 Bang et al.
2009/0261924 A1 * 10/2009 Barrois et al. ..... 333/206

* cited by examiner

*Primary Examiner* — Seungsook Ham
(74) *Attorney, Agent, or Firm* — Baker & Hostetler LLP

(57) ABSTRACT

A filter includes a cross-coupling link which includes a crossbar, a first vertical support attached to one end of the crossbar, a second vertical support attached to another end of the crossbar, a first coupling arm attached to the first vertical support, a second coupling arm attached to the second vertical support, a first adjustable support attached to the first coupling arm at one end and grounded at another end, and a second adjustable support attached to the second coupling arm at one end and grounded at another end.

17 Claims, 7 Drawing Sheets

FILTER APPARATUS AND METHOD

FIELD OF THE INVENTION

The present invention relates to filters having cross-coupling structures for resonator induction.

BACKGROUND OF THE INVENTION

Many modern conveniences, such as radio, television, mobile telephones, and mobile data services, depend on reliable wireless communication technology. Since multiple services must co-exist within the same environment, it is critically important that the industrial high-power radio frequency broadcasting equipment supporting these services only transmit radio frequency energy within its appropriate allocated frequency band. A failure in RF broadcasting equipment to constrain its output frequencies could disrupt other wireless services, creating a major public inconvenience and resulting in potential consequences for the equipment operator.

This issue becomes more critical as the quantity of services crowding the common airwaves increases. Furthermore, since broadcasting equipment uses large quantities of energy, some types of failures can possibly result in physical damage, fire, explosions, and injury to nearby personnel.

It is common practice in the industry to use cross-coupling resonant filters, which provide a restrictive link conveying only the desired frequency bands. Energy in other undesired frequency bands is either not passed across the link, or is absorbed by the link and converted to heat. Multiple capacitors of appropriate values limit high frequencies from passing, while inductors limit low frequencies. Meanwhile, any remaining unwanted high frequency energy is dissipated as heat, and a central parallel inductive grounded loop dissipates unwanted low frequency energy. The interaction of these effects creates a narrowly defined range of frequencies that can make it through. The rate of energy loss of a filter is known as the quality factor or "Q" of the filter. If a larger "Q," i.e., a lower rate of energy loss, is desired, without otherwise changing the behavior of the filter, in general the values of all the elemental components should be increased by the same factor. For example, you can double the size of the inductors and the capacitors. Unfortunately, doubling the sizes requires more physical space, which can be a problem, especially in devices where small size is important, such as mobile telephones.

Many variations of this concept exist, and it is well-known how to calculate the exact behavior of these devices in response to signals of various frequencies, using equations that consider the arrangement of the constituent elemental devices and their values. Some factors that must be taken into account when designing such filter include the quality factor needed, the amount of phase that can be shifted, and how much signal loss is permitted. However, conventional filters are not capable of handling high power applications while maintaining a desired coupling bandwidth. Further, conventional filters do not have adjustable cross-coupling and good thermal conduction while reducing high potential voltage.

Accordingly, there is a need and desire to provide a filter for handling high power applications with adjustable cross-coupling and good thermal conduction while reducing high potential voltage and maintaining desired coupling bandwidth.

SUMMARY OF THE INVENTION

Embodiments of the present invention advantageously provide a filter for handling high power applications with adjustable cross-coupling and good thermal conduction while reducing high potential voltage and maintaining desired coupling bandwidth.

An embodiment of the invention includes a filter including a cross-coupling link which includes a crossbar, a first vertical support attached to one end of the crossbar, a second vertical support attached to another end of the crossbar, a first coupling arm attached to the first vertical support, a second coupling arm attached to the second vertical support, a first adjustable support attached to the first coupling arm at one end and grounded at another end, and a second adjustable support attached to the second coupling arm at one end and grounded at another end.

Another embodiment includes a method of tuning a filter, the method including adjusting a first grounded support attached to a first coupling arm, the first coupling arm being attached to a first vertical support, the first vertical support being attached to a crossbar, adjusting a second grounded support attached to a second coupling arm, the second coupling arm being attached to a second vertical support, the second vertical support being attached to the crossbar, and adjusting a distance between the first and second coupling arms.

Another embodiment includes a filter including a cross-coupling means including a crossbar, a first means for vertical support attached to one end of the crossbar, a second means for vertical support attached to another end of the crossbar, a first means for coupling attached to the first means for vertical support, a second means for coupling attached to the second means for vertical support, a first means for adjustable support attached to the first means for coupling at one end and grounded at another end, and a second means for adjustable support attached to the second means for coupling at one end and grounded at another end.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The above-mentioned and other features and advantages of this disclosure, and the manner of attaining them, will become more apparent and the disclosure itself will be better understood by reference to the following description of various embodiments of the disclosure taken in conjunction with the accompanying figures, wherein.

DETAILED DESCRIPTION OF THE INVENTION

In the following detailed description, reference is made to the accompanying drawings, which form a part hereof and show by way of illustration specific embodiments in which the invention may be practiced. These embodiments are described in sufficient detail to enable those skilled in the art to practice them, and it is to be understood that other embodiments may be utilized, and that structural, logical, processing, and electrical changes may be made. It should be appreciated that any list of materials or arrangements of elements is for example purposes only and is by no means intended to be exhaustive. The progression of processing steps described is an example; however, the sequence of steps is not limited to that set forth herein and may be changed as is known in the art, with the exception of steps necessarily occurring in a certain order.

Figure 1:
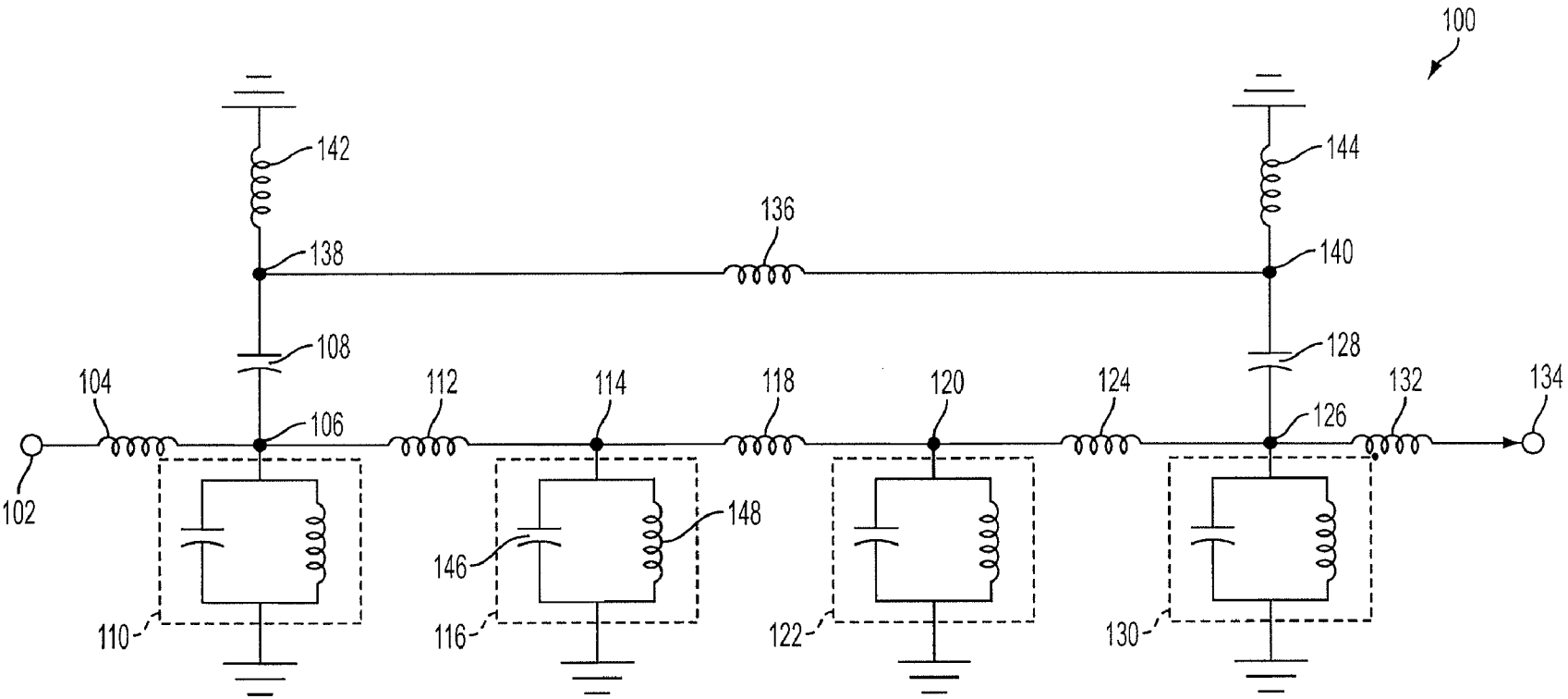
FIG. 1 is a circuit diagram of a cross-coupling link in accordance with an embodiment of the present invention.
Figure 2B:
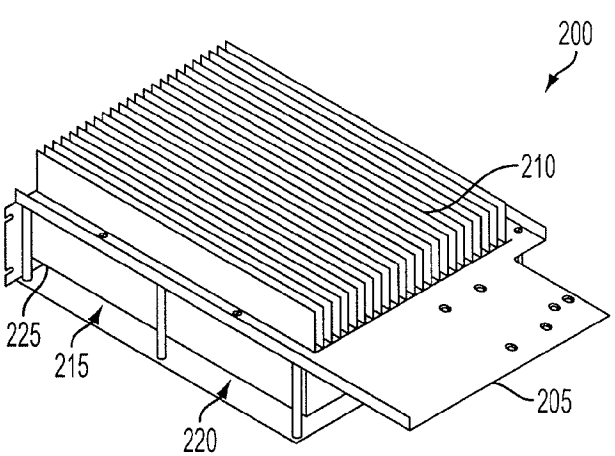
FIG. 2B is a perspective view of a filter constructed in accordance with an embodiment of the present invention.
Figure 2D:
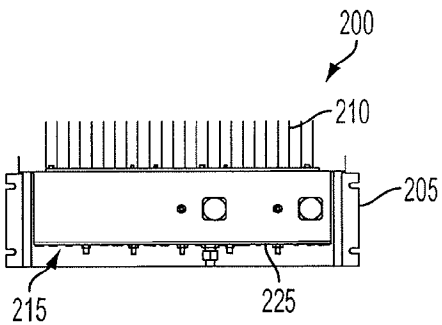
FIG. 2D is a rear schematic view of a filter constructed in accordance with an embodiment of the present invention.
Figure 2A:
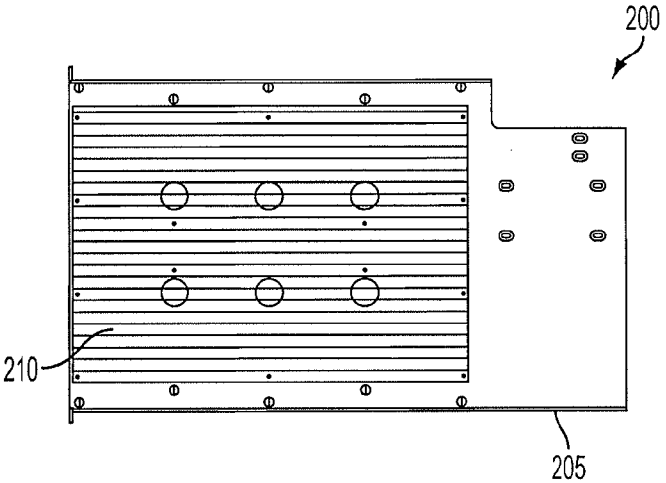
FIG. 2A is a top schematic view of a filter constructed in accordance with an embodiment of the present invention.
Figure 2C:
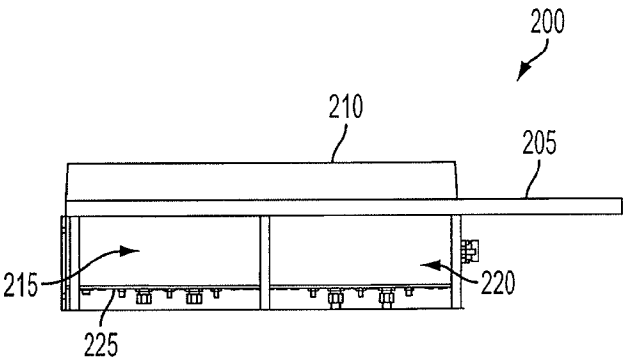
FIG. 2C is a side schematic view of a filter constructed in accordance with an embodiment of the present invention.

The invention will now be described with reference to the drawing figures in which like reference numerals refer to like parts throughout. FIG. 1 shows a circuit diagram of a filter 100 which simplifies the components of the filter 100 into capacitive and inductive elements. The filter 100 receives a signal at input 102, which sends the signal to one end of an input inductor 104.

The other end of the input inductor 104 is electrically connected to a first node 106. Also electrically connected to the first node 106 are a first capacitor 108, a first grounded resonator 110, and one end of a first series inductor 112. The other end of the first series inductor 112 is electrically connected to a second node 114. Also electrically connected to the second node 114 are a second grounded resonator 116 and one end of a second series inductor 118. The other end of the second series inductor 118 is electrically connected to a third node 120. Also electrically connected to the third node 120 are a third grounded resonator 122 and one end of a third series inductor 124. The other end of the third series inductor 124 is electrically connected to a fourth node 126. Also electrically connected to the fourth node 126 are a second capacitor 128, a fourth grounded resonator 130, and one end of an output inductor 132. The other end of the output inductor 132 is the output 134 of the filter 100.

Parallel to the series inductors 112, 118, 124 is a parallel inductor 136, which is electrically connected to the first and second capacitors 108, 128 at respective fifth and sixth nodes 138, 140. A first grounded parallel inductor 142 is electrically connected to the fifth node 138, while a second grounded parallel inductor 144 is electrically connected to the sixth node 140. Each resonator 110, 116, 122, 130 includes a respective resonator capacitor 146 and a resonator inductor 148 which are electrically connected in parallel.

As depicted in FIGS. 2A-2D, a filter 200 having a cross-coupling similar to that shown for filter 100 includes a container 205, which may be constructed of an electrically and thermally conductive material, such as metal. One or more heatsinks 210 may be attached to the container 205. An equivalent alternative method of removing heat may be employed, such as a liquid circulation system. At least four individual internal chambers of which 215 and 220 represent two such chambers within the exterior of the container 205 may be provided, each being constructed of an electrically and thermally conductive material. The filter 200 further includes one or more electrical ground connections, e.g., ground plane 225, electrically communicative with the exterior of the container 205.

Figure 3:
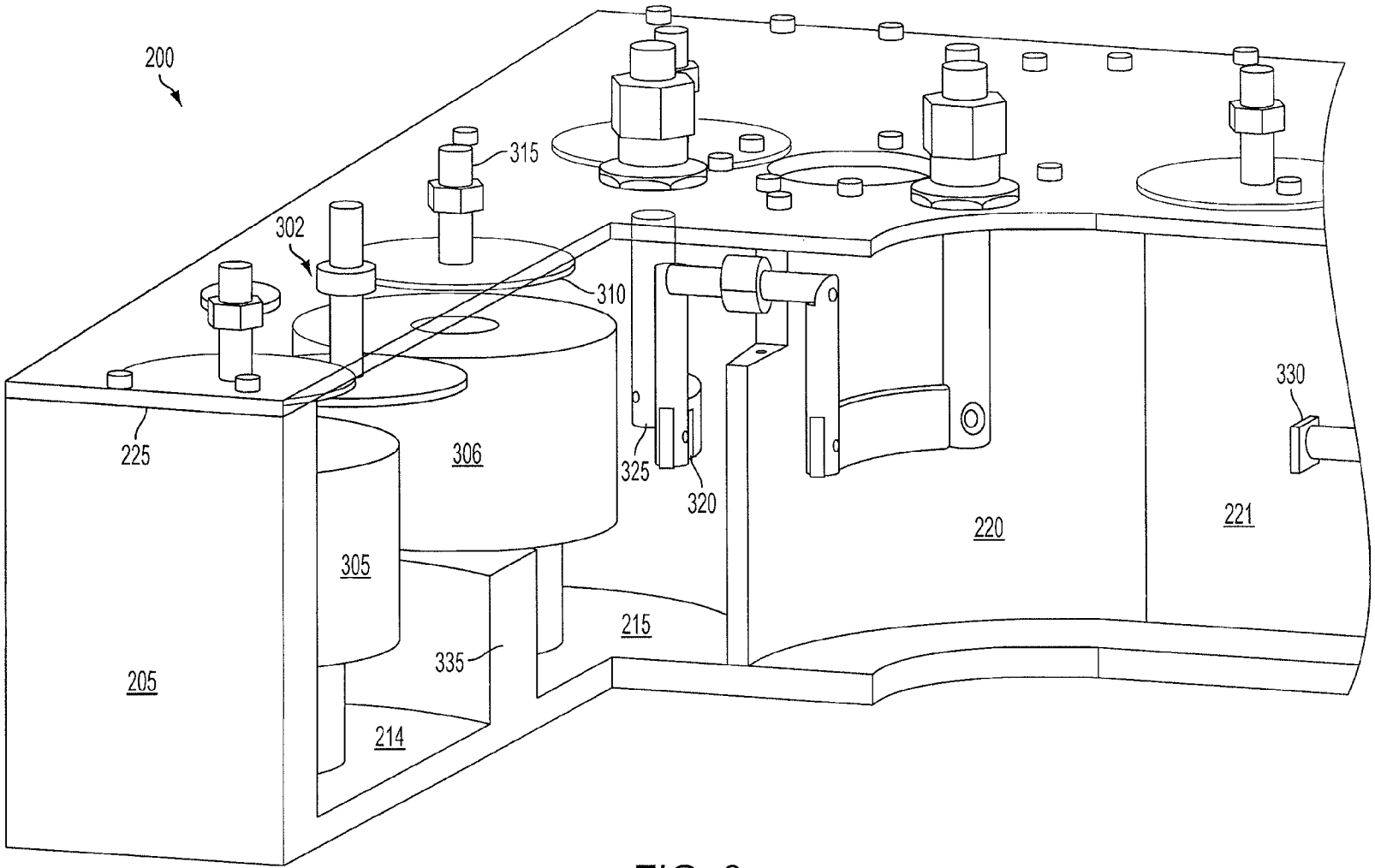
FIG. 3 is a cutaway schematic view of a portion of a filter constructed in accordance with an embodiment of the present invention.

FIG. 3 shows detail of contents of the first internal chamber 215. The first internal chamber 215 includes a first resonator 306 configured to interface with a first RF signal from an input 302, such as input 102 of FIG. 1. The first resonator 306 may function similarly to the first grounded resonator 110, and may include a high-dielectric material on its surface to aid in capacitive coupling. A second resonator 305 may function similarly to the second grounded resonator 116, and may include a high-dielectric material on its surface to aid in capacitive coupling.

A first tuning disc 310, which connects to electrical ground and may function as part of an electrical capacitor to ground, may be placed in close proximity to the first resonator 306, so as to be capacitively coupled to the first resonator 306. A first tuning mechanism 315 may allow adjustment of the distance of the first tuning disc 310 from the first resonator 306. A first electrically and thermally conductive adjustable coupling arm 320 may be positioned in the first chamber 215 an adjustable distance away from the first resonator 306 and is capacitively couplable to the first resonator 306. A first adjustable support 325 for the first adjustable coupling arm 320 may support the first coupling arm 325 in the first chamber 215 and allow the first coupling arm 320 to be repositioned, electrically grounded, and thermally sinked. The first adjustable support 325 will be discussed in more detail below with reference to FIG. 6. FIG. 3 also shows an output 330 in a third internal chamber 220, which receives a filtered signal, as discussed below with respect to FIG. 4. There may also be a first septum wall 335 in between the first and second resonators 306, 305 to allow for inductive coupling, such as that provided by the first series inductor 112.

Figure 4:
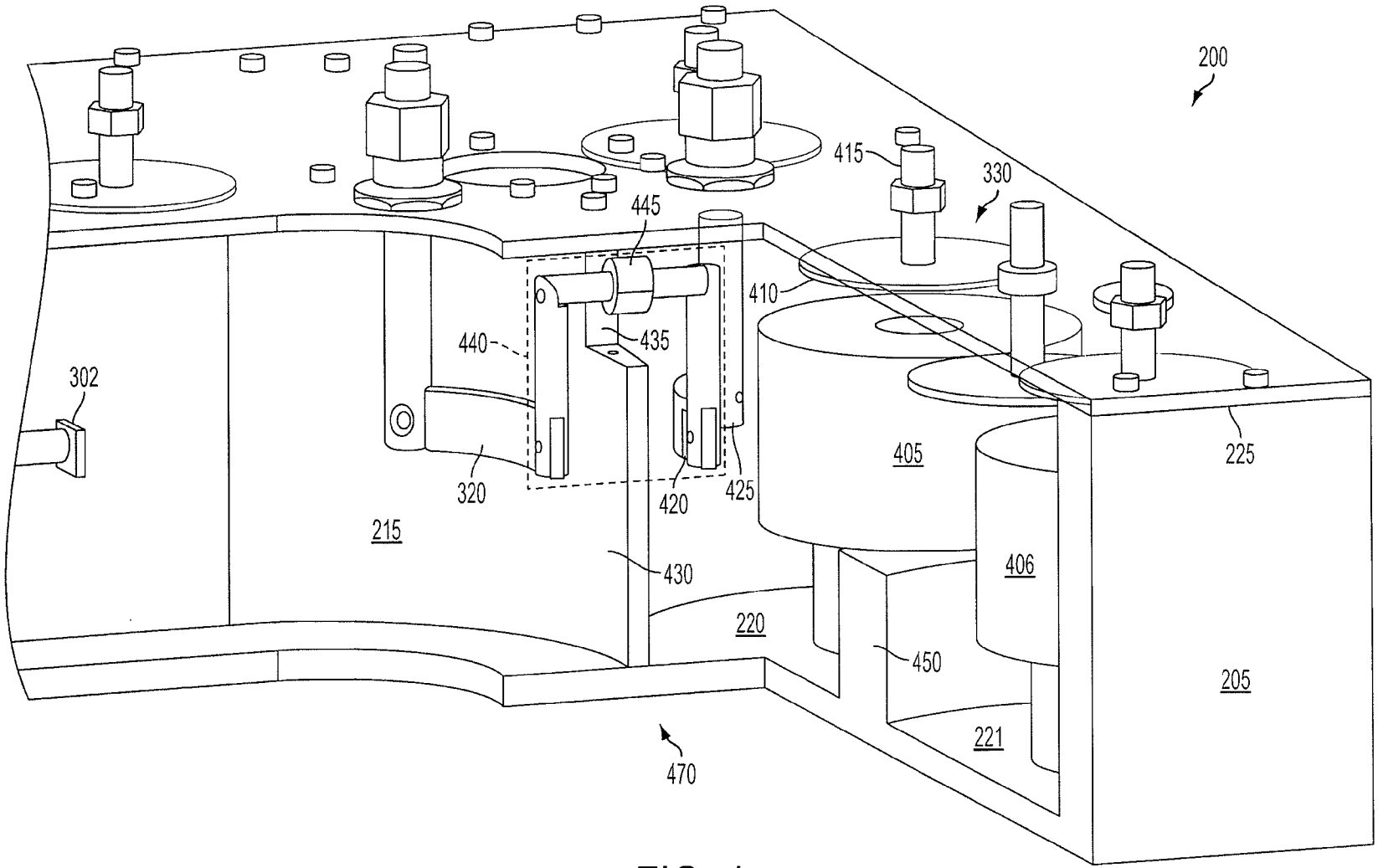
FIG. 4 is a cutaway schematic view of another portion of a filter constructed in accordance with an embodiment of the present invention.

FIG. 4 shows detail of contents of the third and fourth internal chambers 220, 221. The third chamber 220 may contain a mirror image of the contents of the first chamber 215. In the third chamber 220 may be an output 330, a fourth resonator 405, similarly configured to interface with a capacitively coupled signal from first resonator, and placed in the third internal chamber 220. The fourth resonator 405 may function similarly to the fourth grounded resonator 130, and may include a high-dielectric material on its surface to aid in capacitive coupling. A fourth chamber 221 includes a third resonator 406 which may function similarly to the third grounded resonator 122, and may include a high-dielectric material on its surface to aid in capacitive coupling. The output 330 may be inductively coupled (e.g., output inductor 132) to the fourth resonator 405.

A fourth tuning disc 410, similarly configured with respect to the fourth resonator 405 as the first tuning disc 310 is to the first resonator 306, may be placed in the second internal chamber 220. A second tuning mechanism 415 may allow adjustment of the distance of the second tuning disc 410 from the fourth resonator 405. A second electrically and thermally conductive adjustable coupling arm 420 may be positioned in the third chamber 220 an adjustable distance away from the fourth resonator 405 and is capacitively couplable to the fourth resonator 405. A second adjustable support 425 for the second adjustable coupling arm 420 may support the second coupling arm 425 in the third chamber 220 and allow the second coupling arm 420 to be repositioned, electrically grounded, and thermally sinked. The second adjustable support 425 will be discussed in more detail below with reference to FIG. 6.

A grounded Faraday cage-type dividing wall 430 may include a portal 435 between the two internal chambers 215, 220. An inductive loop completion structure 440, electrically joining the two coupling arms 320, 420, may be electrically grounded by way of the coupling arms 320, 420 and the adjustable supports 325, 425, and may pass through the portal 435. An insulating barrier 445 may prevent the inductive loop completion structure 440 from making electrical contact with the dividing wall 430 while passing through the portal 435 between the chambers 215, 220. The coupling arms 320, 420 may provide a capacitance function, similarly to that of the first and second capacitors 108, 128 of FIG. 1. There may also be a second septum wall 450 in between the third and fourth chambers 220, 221 and the third and fourth resonators 405, 406 to allow for inductive coupling, such as that provided by the third series inductor 124. A third septum wall 470 may also be between the second and fourth chambers 214, 221.

Figure 5:
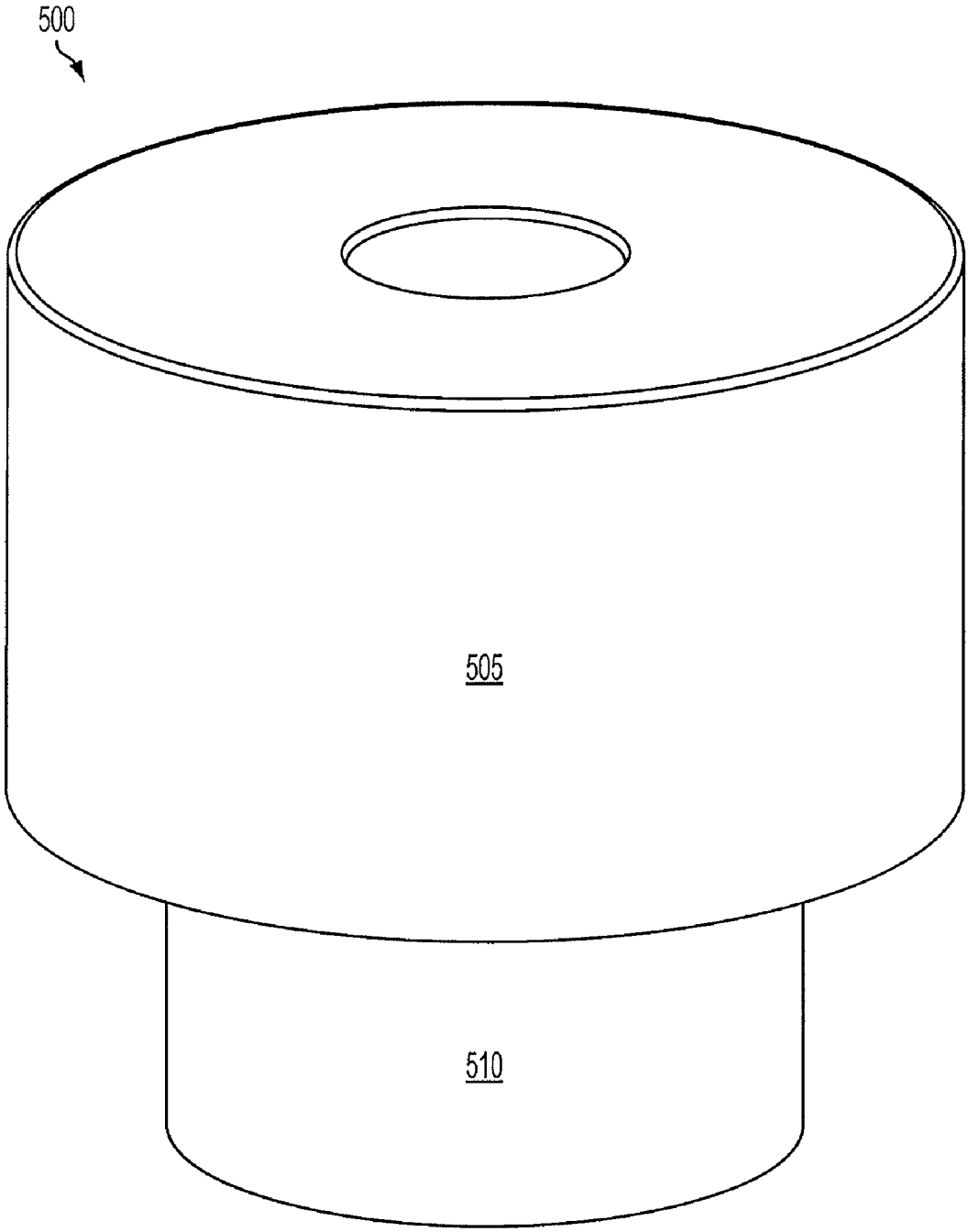
FIG. 5 is a resonator constructed in accordance with an embodiment of the present invention.
Figure 6A:
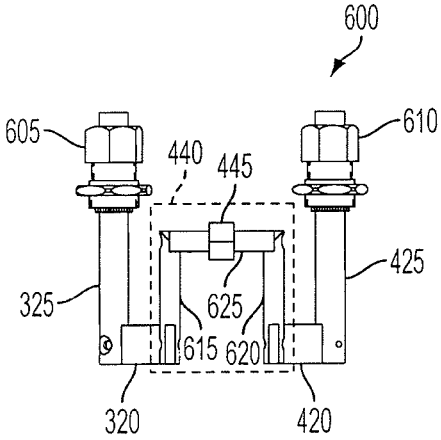
FIG. 6A is a front schematic view of a cross-coupling structure in accordance with an embodiment of the present invention.
Figure 6D:
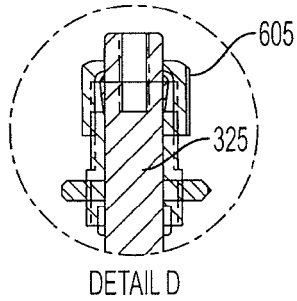
FIG. 6D is a detail view of the FIG. 6C cross-coupling structure taken at the section D.
Figure 6B:
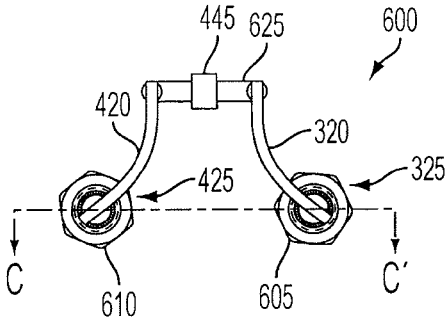
FIG. 6B is a top schematic view of a cross-coupling structure in accordance with an embodiment of the present invention.
Figure 6E:
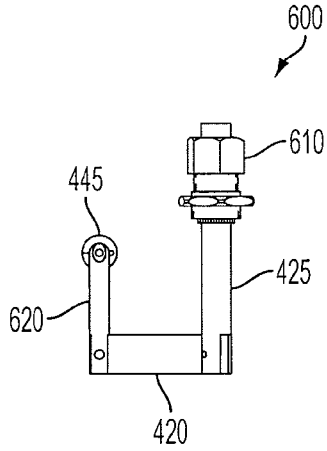
FIG. 6E is a side schematic view of a cross-coupling structure in accordance with an embodiment of the present invention.
Figure 6C:
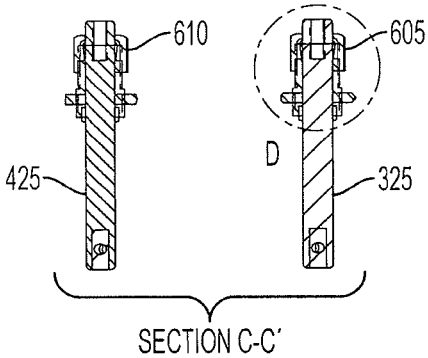
FIG. 6C is a cross-sectional view of the FIG. 6B cross-coupling structure taken along the line C-C'.
Figure 6F:
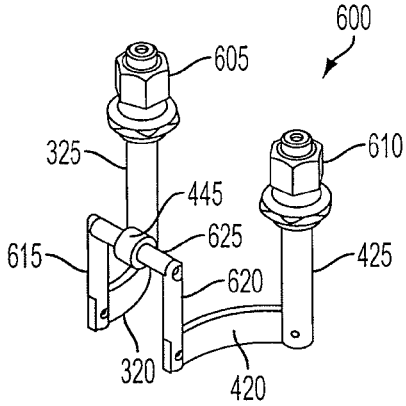
FIG. 6F is a perspective view of a cross-coupling structure in accordance with an embodiment of the present invention.

FIG. 5 depicts a resonator structure 500, which includes a resonator portion 505, e.g., the first or second resonators 305, 310. The resonator portion 505 is supported by a base 510 which electrically isolates the resonator from ground. The base 510 may further provide heat dissipation, and may be constructed of a thermally conducting material, e.g., low loss alumina.

The filter 200 provides high power handling of the resonator 500, e.g., a compact TE01 delta resonator, using a cross-coupling approach to minimize thermal buildup and reducing high potential voltage while maintaining a desired coupling bandwidth. The cross-coupling structure is tunable to maintain a desired coupling bandwidth over dimensional tolerances within the filter 200.

FIGS. 6A-6F illustrate various views of a cross-coupling structure 600. The first coupling arm 320 is attached to the first adjustable support 325. The second coupling arm 420 is attached to the second adjustable support 425. The first and second adjustable supports 325, 425 may each provide an inductive function, similarly to the first and second grounded parallel inductors 142, 144 of FIG. 1. Each adjustable support 325, 425 has a respective attached clamping nut 605, 610 for adjusting the distance of the respective coupling arm 320, 420 from the ground plane 225. Each coupling arm 320, 420 has a respective vertical support 615, 620 which each connect to a crossbar 625. The crossbar 625 may be, for example, a rod structure, and may be constructed from an electrically conducting material, e.g., copper. The crossbar 625 may function similarly to the parallel inductor 136 illustrated in FIG. 1.

Figure 7:
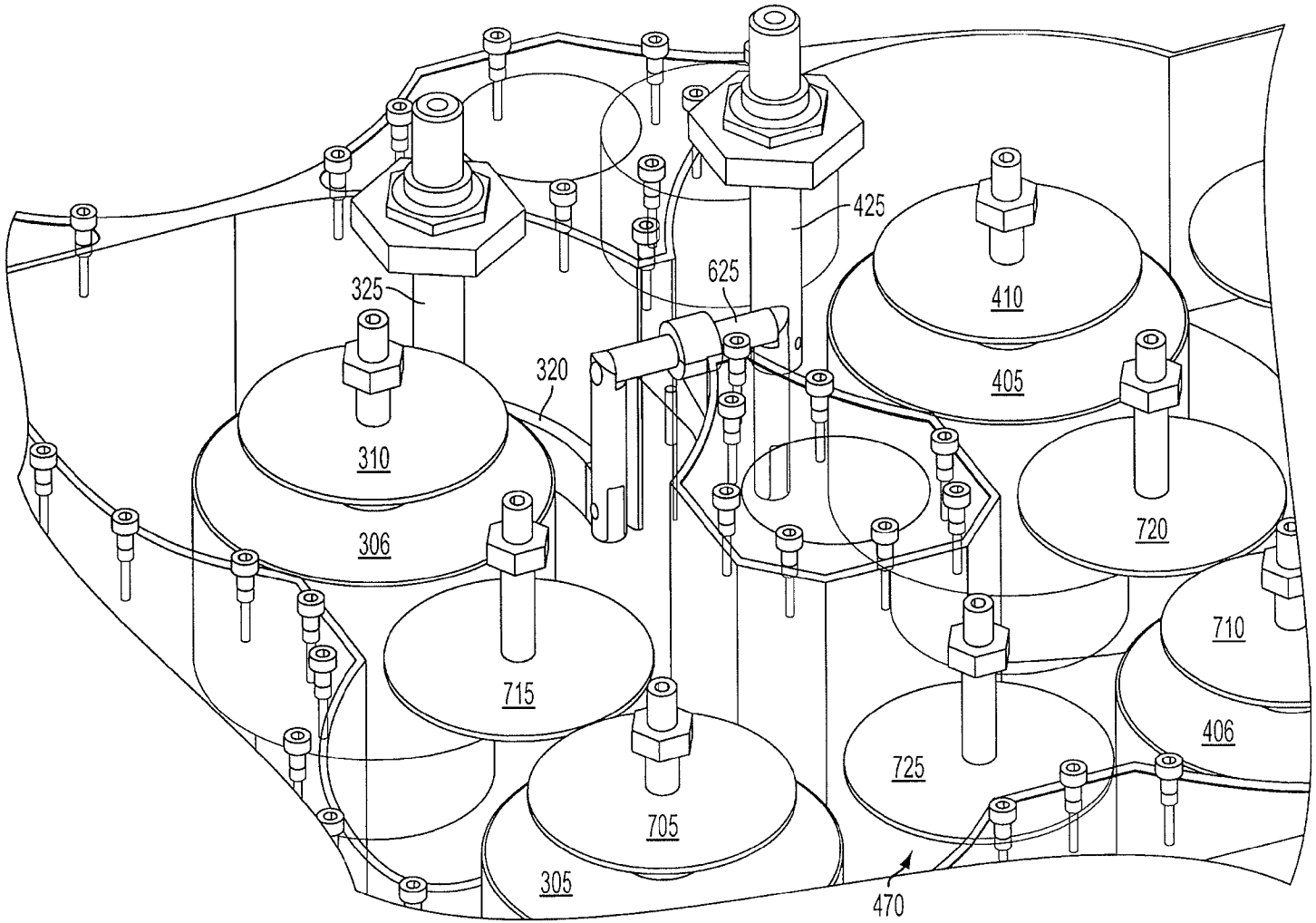
FIG. 7 is a perspective view of a portion of a filter constructed in accordance with an embodiment of the present invention.

FIG. 7 shows all four resonators 306, 305, 406, 405 with their respective tuning discs 310, 705, 710, 410. The first coupling arm 320 may be seen adjacent the first resonator 306. Additional tuning discs 715, 720, 725 having adjustable heights may be located in between each pair of adjacent resonators for additional tuning.

The aforementioned insulating barrier 445 may be located on the crossbar 625 and may be constructed of an insulating material, such as polytetrafluoroethylene (PTFE), which is also known by its DuPont-owned brand name Teflon®. Such insulation may preserve the integrity of the inductive loop completion structure 440 and the characteristic impedance of the portal 435. The distance between the coupling arms 325, 425 may be adjustable to assist with tuning of the filter 200.

The power handling of the compact filter 200 utilizing resonators 500 may be achieved through very low loss dielectric materials to minimize the thermal heating due to power dissipated through the filter 200. The geometry of the supports 325, 425, can be chosen to minimize the resonator losses and maximize the thermal conductivity to the container 205 for pulling a maximum amount of heat away from the dielectric resonator 500. The heatsink 210 may also be employed on the outside of the filter 200 to minimize the temperature rise of the filter 200 and to help in pulling away more thermal heat from the resonator 500.

The cross-coupling structure provides the grounded loop 440 in which elliptic function transmission zeroes are achieved via the proper phase length of the grounded cross-coupling structure. The loop 440 is larger than in conventional cross coupling structures, so a high dielectric material may compensate for the additional space needed with a higher capacitance than conventional cross coupling structures provide. Proper sizing and gaps can minimize a high potential voltage source, such as the cross-coupling structure 600, from a potential arcing to a lower potential voltage source, such as the container 205. This may be achieved through removing sharp edges from surfaces of the cross-coupling structure, preferably all sharp edges from all surfaces. The inductive supports 325, 425 may be mechanically sized to aid in thermal dissipation of the cross-coupling structure 600 to the container 205. The tuning can be performed with external tools, e.g., a wrench, to adjust the cross-coupling structure 600 during optimization of the filter's transmission zeroes. Once adjusted, the tools may be removed from the cross-coupling structure 600, and the cross-coupling structure 600 may be locked in place, e.g., using the clamping nuts 605, 610.

It should further be appreciated that embodiments may be used for medical devices, such as for targeted radio wave radiation therapy. Embodiments could be used in space, for example, on communication satellites. Embodiments could be used to generate targeted focused beams of energy for example, for cooling or cooking food, propelling devices with radio waves, or to gather energy, such as solar energy.

The processes and devices in the above description and drawings illustrate examples of only some of the methods and devices that could be used and produced to achieve the objects, features, and advantages of embodiments described herein. Thus, they are not to be seen as limited by the foregoing description of the embodiments, but only limited by the appended claims. Any claim or feature may be combined with any other claim or feature within the scope of the invention.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A filter, comprising:

a first cylindrical dielectric resonator electrically coupled to a signal input port;

a second cylindrical dielectric resonator electrically coupled to the first resonator;

a third cylindrical dielectric resonator electrically coupled to the second resonator;

a fourth cylindrical dielectric resonator electrically coupled to the third resonator and to a signal output port; and a cross-coupling link, electrically coupled to the first and fourth resonators, comprising:

a crossbar having two ends;

a first fixed vertical support depending from one end of the crossbar;

a second fixed vertical support depending from the other end of the crossbar;

a first curved horizontal coupling arm, extending from the lower end of the first vertical support, electrically coupled to the first resonator;

a second curved horizontal coupling arm, extending from the lower end of the second vertical support, electrically coupled to the fourth resonator;

a first adjustable vertical support, extending upwards from an end of the first coupling arm, including a mechanical fastener disposed at an upper end; and a second adjustable vertical support, extending upwards from an end of the second coupling arm, including a mechanical fastener disposed at an upper end.

2. The filter of claim 1, wherein the mechanical fasteners are clamping nuts and the upper ends of the adjustable vertical supports are threaded.

3. The filter of claim 1, wherein a horizontal distance between the first and second coupling arms is adjustable.

4. The filter link of claim 1, wherein the edges of the cross-coupling link are rounded.

5. The filter of claim 1, further comprising a container surrounding the first, second, third, and fourth resonators and the cross-coupling link.

6. The filter of claim 5, further comprising a heat sink disposed on an outer surface of the container.

7. The filter of claim 1, further comprising a first tuning disc electrically connected to electrical ground and capacitively coupled to the first resonator.

8. The filter of claim 7, further comprising:

a second tuning disc electrically connected to electrical ground and capacitively coupled to the second resonator;

a third tuning disc electrically connected to electrical ground and capacitively coupled to the third resonator;

a fourth tuning disc electrically connected to electrical ground and capacitively coupled to the fourth resonator.

9. The filter of claim 1, further comprising a first septum wall located between the first and second resonators.

10. The filter of claim 9, further comprising a second septum wall located between the second and third resonators.

11. The filter of claim 10, further comprising a third septum wall located between the third and fourth resonators.

12. The filter of claim 1, further comprising a grounded Faraday cage-type dividing wall, disposed between the first and fourth resonators, including a portal through which the crossbar passes.

13. The filter of claim 12, wherein the crossbar is an electrically conducting rod.

14. The filter of claim 13, further comprising an insulating barrier, disposed around at least the central portion of the crossbar, to prevent the crossbar from contacting the dividing wall.

15. The filter of claim 1, wherein the first, second, third and fourth resonators are TE01 delta resonators.

16. The filter of claim 8, wherein the distances between the first, second, third and fourth tuning discs and a ground plane are independently adjustable.

17. The filter of claim 1, wherein a vertical distance between the first and second coupling arms and a ground plane is adjustable.

* * * * *